US005564462A

United States Patent [19]

Storch

[11] Patent Number: 5,564,462

[45] Date of Patent: Oct. 15, 1996

[54] WATER CONSERVATION DELIVERY SYSTEM USING TEMPERATURE-CONTROLLED BY-PASS CIRCUIT

[76] Inventor: Paul Storch, 13 Cutter Mill Rd., Great Neck, N.Y. 11021

[21] Appl. No.: 326,087

[22] Filed: Oct. 19, 1994

[51] Int. Cl.[6] ..... F24H 1/00

[52] U.S. Cl. ..... 137/337; 137/563; 126/362; 417/32

[58] Field of Search ..... 137/337, 563; 417/32; 126/362

[56] References Cited

U.S. PATENT DOCUMENTS

| | | | |
|---|---|---|---|
| 3,530,837 | 9/1970 | Olney | 126/362 |
| 4,606,325 | 8/1986 | Lujan, Jr. | 417/32 |
| 4,750,472 | 6/1988 | Fazekas | 126/362 |
| 4,945,942 | 8/1990 | Lund | 126/362 |
| 5,261,443 | 11/1993 | Walsh | 137/337 |

FOREIGN PATENT DOCUMENTS

| | | | |
|---|---|---|---|
| 339948 | 12/1930 | United Kingdom | 137/337 |

*Primary Examiner*—A. Michael Chambers
*Attorney, Agent, or Firm*—Lackenbach Siegel Marzullo Aronson & Greenspan, P.C.

[57] ABSTRACT

A temperature controlled water recirculation system includes an adjustment valve for adjusting the quantities of water received from hot and cold water lines are fed to a shower nozzle. A controller, such as a temperature sensor, a timer, fluid flow meter, or the like is used for establishing the point at which a diverting valve diverts water from a recirculating return line to a shower nozzle. The return valve, therefore, determines at point in time recirculation ceases and dispensing of the water commences. In this way, water is conserved by recirculation of mixed water which cannot be used because its temperature is below or above a pre-selected threshold temperature.

20 Claims, 1 Drawing Sheet

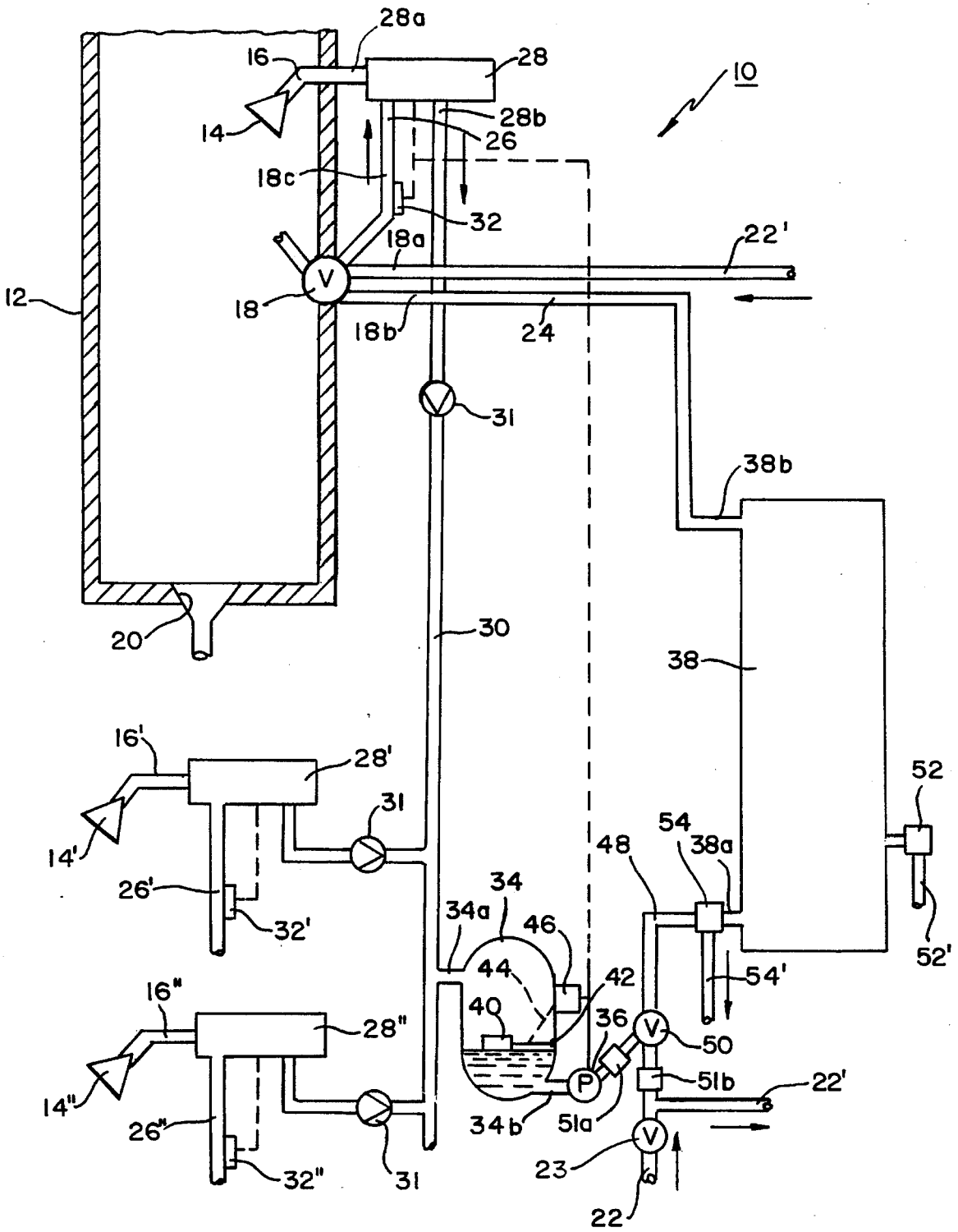
28a
16
28
10
14
28b
26
18c
32
18a
22'
12
18
18b
24
31
38b
20
30
38
16'
28'
52
31
54
48
38a
14'
26'
34
32'
34a
46
52'
44
42
54'
16"
40
36
28"
50
14"
51b
22'
26"
34b
51a
23
32"
31
22

WATER CONSERVATION DELIVERY SYSTEM USING TEMPERATURE-CONTROLLED BY-PASS CIRCUIT

BACKGROUND OF THE INVENTION

This invention generally relates to water delivery systems and, more specifically, to a temperature controlled system which includes a water conservation by-pass circuit.

While most people have long taken water for granted, many are learning to recognize that this is a precious resource which must not be wasted. Many regions in this country and in other countries have chronic water shortage problems, and massive and costly water conservation plans are implemented to conserve this resource. Many localities, furthermore, in order to enforce conservation, mandate that water delivery to businesses and homes be metered so that end users pay for the water that they use. For these reasons, water is an important resource and must always be conserved and not wasted needlessly.

One example where considerable waste has consistently occurred, and not without at least a reasonable basis therefor, is the water that is wasted when a shower is first turned on. Because there is a considerable amount of "standing" water in the hot water pipes or lines between the hot water heater and the shower nozzle, it is clear that the water that is initially dispensed from the shower will be cold water, regardless of the setting of the shower temperature control valve. Until the cold water has been depleted from the hot water line and new hot water replaces it, the temperature of the water coming out of the shower head is totally beyond the control of the user. For this reason, users typically turn the shower on and allow the water to simply go down the drain until the standing water has been depleted and the warm water starts to come out of the shower nozzle. Only at that time, can the temperature be adjusted to the desired temperature and the shower be used. The water that is initially discarded represents a significant waste of water, particularly when considering the tens of millions of showers that are taken daily. Such needless waste of water is costly not only to the various localities and water distribution systems but also to the user who, one way or another, is charged for the water. Also, the end user is currently needlessly paying for heating of water that is discarded until such time that the water discharged by the nozzle attains a sufficiently high desired temperature. Therefore, even warm water is allowed to go down the drain until the desired temperature has been attained.

Although the aforementioned condition is one that has existed undoubtedly since showers were first invented, very little has been done to ameliorate this problem.

In U.S. Pat. No. 2,983,487, a liquid supply system is disclosed for providing water at a desired temperature in photo-finishing processes, where the system checks the temperature of the water entering into the system and seeks to maintain the temperatures so that the mixed water at the outlet will be within a desired range. However, the emphasis is on maintaining a desired dispensing temperature, as opposed to the conservation of water until such time that the desired temperature has been achieved.

In U.S. Pat. No. 3,091,393, a fluid amplifier mixing control system is disclosed to adjust the temperature by the use of an oscillating member. However, water is not redirected back to the source. In U.S. Pat. No. 3,958,555, a fluid supply system includes a fluid blending valve which discharges blended liquid into a recirculation pipeline. Fluid is drawn off and at least a portion of the recycled liquid is fed to a heat exchanger to insure that the temperature of the recycled liquid is maintained at a desired value. A thermostatic control valve is provided responsive to the recycled liquid temperature which cooperates with the exchange to maintain the recycled liquid temperature at a desired value. The system, therefore, is primarily concerned with maintaining water temperature as opposed to water conservation during initial turn on of the system.

In U.S. Pat. Nos. 4,249,695 and 4,294,402, control devices for heaters are disclosed which are concerned with conserving heat as opposed to saving water.

In U.S. Pat. Nos. 4,322,031 and 4,330,081, water controls are disclosed for controlling the temperatures for washing machines and sanitary mixing valves, and have the same drawbacks as the previously described systems.

In view of the above art, it is clear that conservation of water has not been a primary and foremost factor in connection with heated water dispensing systems.

SUMMARY OF THE INVENTION

Accordingly, it is an object of the present invention to provide a temperature controlled water recirculation system which is not possessed of the disadvantages inherent in prior art systems.

It is another object of the present invention to provide a temperature controlled water recirculation system as in the previous object which is simple in construction and economical to implement.

It is still another object of the present invention to provide a temperature controlled water recirculation system as in the previous objects which can be installed in new homes as well as retro-fitted into existing homes.

It is yet another object of the present invention to provide a temperature controlled water recirculation system as suggested in the previous objects which is effective in conserving water and implementing significant waste reductions in the use of shower stalls.

It is a further object of the present invention to provide a temperature controlled water recirculation system of the type under discussion which can be used in connection with one shower stall or a plurality of shower stalls.

It is still a further object of the present invention to provide a temperature controlled water recirculation system of the type under discussion which can insure that the person using the system is not exposed to extreme cold or hot water temperatures.

In order to achieve the above objects, as well as others which will become apparent hereafter, a temperature controlled water recirculation system in accordance with the present invention comprises a first supply means for supplying cold water and second supply means for supplying hot water. Adjusting valve means is provided for selectively mixing the hot and cold water of said first and second supply means to select the desired water temperature. Water dispensing means is provided for dispensing water at said selected temperature. Sensing means is provided for sensing the temperature of the mixed water before it is dispensed by said water dispensing means. Water is diverted by water return means from said water dispensing means to at least one of said supply means when the temperature sensed by said sensing means is outside a predetermined water temperature range. In this way, water is conserved by recirculation of mixed water which cannot be used because its temperature is below or above said predetermined temperature range. The present invention can be used to insure that water is diverted to at least one of said supply means and prevented from being dispensed from the shower head or nozzle when the water is below a first predetermined water temperature and/or above a second predetermined temperature.

BRIEF DESCRIPTION OF THE DRAWINGS

These and other objects will become apparent when the drawings of the present invention are considered in detail along with the present specification, taken with the drawing as follows:

The single FIGURE is a diagrammatic representation of a temperature controlled water recirculation system in accordance with the present invention, shown partially in cross-section and partially broken away to illustrate how the system can be used with a single shower stall or with a plurality of shower stalls.

DESCRIPTION OF THE PREFERRED EMBODIMENT

Referring now specifically to the drawing in which identical or similar parts are designated by the same reference numerals throughout, and referring specifically to the single FIGURE, the temperature controlled water delivery system in accordance with the present invention is generally designated by the reference numeral 10. While it will be evident to those skilled in the art that the system may be used with numerous other applications, it will be specifically described in connection with a household system for supplying heated water for a plurality of bath or shower installations. Although one installation, namely shower stall 12, is shown in greater detail, it will be evident that a plurality of such installations may be connected to the system, as will be more fully discussed below.

Shower stall 12 includes a shower nozzle 14 mounted on a pipe or conduit 16 that generally extends through building wall or wall of the shower unit. The shower stall 12 is provided with a conventional actuation valve 18 that is effective to turn the water on as well as adjust the mixture of cold and hot water to provide a desired temperature for the water that is released through the nozzle 14. However, as would be evident to those skilled in the art, one or more of the temperature control components forming part of this invention can be incorporated into a modified actuation valve 18. The shower stall 12 is provided with a drain 20 in the floor thereof as shown.

The system 10 is provided with a main supply of cold water, which enters the house at 22. A shut-off valve 23 is typically provided for shutting the water off from the main. The shut-off valve 23, when open, supplies the house with domestic water through cold water lines 22'. It will be understood, in this connection, that the cold water lines 22' extend to numerous facilities within the household and only one of such lines is illustrated in the drawing for the sake of simplicity.

The adjustment valve 18 has one inlet port 18*a* connected to the cold water line 22' and another inlet port 18*b* is connected to a hot water line 24. An inlet line 26 of a diverting valve 28 is connected to the outlet port 18*c* of the adjustment valve 18. The diverting valve 28 has two outlet ports, the first 28*a* being connected to the pipe 16 which feeds the shower nozzle 14, while the other outlet port 28*b* is connected to a return pipe or line 30. The diverting valve 28 has, at a minimum, two separate conditions. In the first, the inlet line 26 feeds the outlet pipe 16, while in the other condition the inlet pipe 26 is in fluid flow communication with the return line 30. In the first condition, therefore, the water emanating from the adjustment valve 18 is permitted to flow through the shower nozzle 14. In the second condition, the water from the adjustment valve 18 is diverted into the return line 30. For reasons which will be mentioned hereinafter, the diverting valve 28 may also be a three-position valve, in which case a third condition is provided in which the water in the inlet pipe 26 is also recirculated and water is prevented from flowing out of the nozzle 14 when the water temperature exceeds another, higher pre-determined or set water temperature.

The specific condition or operational state of the valve 28 may be selected in a number of different ways. For example, a microprocessor-based control element may be set with a keypad within the shower stall compartment to set a desired temperature. In the presently preferred embodiment, a temperature sensor 32 is shown mounted on or in physical contact with the inlet line 26 for monitoring the temperature thereof and, therefore, indirectly measuring the temperature of the water flowing within the inlet line. Direct water temperature sensors may also be used within the inlet line 26, the valve 18 or valve 28. The sensor 32 is in the nature of a switch which is electrically connected to the valve 28. The valve 28, which includes an electromagnet or solenoid-type actuator, is configured so that when the sensor 32 senses a cold inlet pipe 26, the valve 28 is moved to the second condition whereby the water emanating from the adjustment valve 18 is diverted through the return line 30. However, when the water temperature in the inlet line 26 rises to a predetermined threshold level, the sensor 32 causes the valve 28 to switch to the first condition in which the water in the inlet line 26 is fed to the pipe 16 and, therefore, dispersed by the shower nozzle 14. Alternatively, the valve 18 may itself be a temperature-sensitive valve which directly senses and reacts to the temperature of the mixed water which emanates from the outlet port 18*c*, in which case the diverting valve and separate sensor 32 may be eliminated and the return line 30 would be connected directly to the valve 18.

As indicated, while only one shower stall 12 has been shown, two additional shower facilities are represented in the FIGURE by shower nozzles 14' and 14". Each of the aforementioned nozzles has an associated pipe 16', 16" on which the associated nozzles are mounted and connected to respective outlet ports of diverting valves 28' and 28" respectively. The valve 28' has a inlet line 26' in which a temperature sensor 32' is mounted, while the second outlet line is in fluid flow communication with the return line 30. Similarly, the diverting valve 28" has an inlet line 26" on which there is mounted a temperature sensor 32", with its second outlet line coupled to the return line 30. Clearly, as many or as few of such shower facilities can be connected throughout a household, in which case the return line 30, directly or indirectly, needs to be brought to each facility so that all the diverted water can be fed to a common location. Preferably, a check valve or one-way valve 31 is arranged in each return line 30 so that water diverted by one of the valve 28, 28', 28" is not permitted to flow through the others. Otherwise, water diverted from one nozzle 14, 14', 14" might undesirably alter the desired temperature at another nozzle. The check valves 31 may be incorporated into the diverting valves 28, 28' and 28".

In accordance with the presently preferred embodiment, the return line 30 is connected to a water holding tank 34 at 34*a* which receives water diverted by the valves 28, 28' and 28". The water holding tank 34 is connected at 34*b* to a pump 36 which is arranged to selectively pump the recirculated water in the water holding tank 34 to a hot water heater 38 through an inlet port 38*a*. It will be clear that the pump 36 cannot arbitrarily and randomly be actuated to force water from the holding tank 34 into the hot water heater since, for example, there may be no recirculated water in the holding tank 34 and running the pump without water may cause damage to the pump. For this reason, in this embodiment, the holding tank 34 is provided with a buoyant floating member 40 pivotally mounted as shown about a pivot point 42, so as to follow the surface of the recirculated water within the holding tank 34. The position of the floating member 40 is monitored by a switch or other sensor 46 by means of any mechanical or other linkage 44. When the level of water drops below a predetermined value (typically in the above-mentioned first condition), the sensor 46 disables the pump 36. However, as soon as there is a sufficient build-up of water, the pump 36 is actuated. Thus, the flow of recirculated water is normally accompanied by operation of the pump 36 to pump the recirculated water temporarily stored within the holding tank 34 into the hot water heater 38 to supplement the water which is brought into the hot water heater by way of the cold water line 22'. Other arrangements may be used to actuate the pump 36. Thus, the pump 36 may be connected to the temperature sensor 32 and operated synchronously with the diverting valve 28. Below a threshold temperature (second above condition) the pump 36 is actuated whenever water is diverted into the holding tank 34. As soon as the selected temperature is reached, the pump 36 is disabled simultaneously with cessation of recirculation of water by the valve 28. In this way, each time the hot water heater 38 is used, the recirculated water within the holding tank 34 can be recycled into the hot water heater and the hot water tank 34 is again emptied and is capable of receiving additional water from the return line 30 in a further recycling of the system.

As will be noted from the FIGURE, the pump 36 directs the water from the holding tank 34 into the hot water tank 38 by means of inlet pipe 48, which also receives water from the cold water line 22 by way of the main valve 23. Since the water from the main is under a predetermined pressure, which may vary from municipality to municipality, it is necessary that the pump 36 urge the water from the holding tank 34 into the hot water heater at a pressure which is higher than that of the cold water main pressure. Thus, for example, if the main water pressure is approximately 60 pounds per square inch (psi), the water from the holding tank 34 is advantageously urged into the inlet pipe 48 at a pressure higher than 60 psi. A pressure-sensitive valve 50 is shown which has two inlets and one outlet, one inlet being connected to the pump 36, the other inlet being connected to the main valve 23, while the outlet is connected to the inlet pipe 48. The pressure-sensitive valve 50 detects the pressure differential between the water at both inlets and allows the water at the higher pressure to pass into the inlet pipe 48 while blocking the water in the lower pressure inlet pipe. Thus, when the pump 36 is off or disabled, the cold water from the main source flows into the hot water heater. However, as soon as the pump 36 is actuated, it generates a higher pressure than the water main pressure and the water in the holding tank 34 is given priority and is forced into the hot water tank while the cold water in the main is blocked. In this connection, in order to prevent contamination of any of the water supplies, a one-way or back flow valve 51A is connected between the pump 36 and the valve 50 and a similar vane 51B is connected between the main valve 23 and the valve 50. In this way, water can only flow into the valve 50 but not in reverse. Such valves are well-known and commonly used in arrangements of this type.

The reference numeral 52 represents a pressure release valve which is commonly provided in water heaters in order to allow water and/or steam to escape when the pressure build up within the tank exceeds a predetermined or threshold level. Such high pressure water or steam is released through a discharge conduit 52'. Typically, such pressure release valves are set to approximately 125–150 psi. Advantageously, there is provided a further pressure relief valve 54 between the valve 50 and the hot water heater inlet pipe 38A which assures that the pump 36 does not generate an unduly high pressure which may cause damage to the hot water heater. The pressure relief valve 54 is selected to open at a pressure threshold level which is between the pressure setting for the pressure relief valve 52 and the pressures generated at the inputs to the valve 50. Thus, for example, the pressure relief valve 54 can be set to approximately 90 or 100 psi, at which point water is released through discharge pipe 54' and directed to the waste or sewer lines.

It should be clear from the foregoing, therefore, that when a user initially turns on an adjustment valve 18, the cold water that would normally be allowed to flow down the drain 20 is initially recirculated by causing the cold water to flow through the return line 30 into the recovery system which includes the water holding tank 34, the hot water heater 38 and the overflow tank or waste line 54. The water will be permitted to emanate from the nozzle 14 only after the "standing" water originally in the hot water line has been recirculated and warm water appears at the nozzles 14. For this reason, the temperature sensors 32 should be placed as close as possible to the shower nozzles 14 so that the rise in temperature at the sensors will substantially correspond to the temperature of the water existing the nozzles 14. The disclosure of the present application has been by way of example only and forms one of the many possible configurations of insulations available to one skilled in the art. The present application in no way attempts to disclose all of the various arrangements that could be utilized in preparing and utilizing the present invention but has been illustrative only. The invention is to be limited in the scope of the invention only by the appendant claims as one skilled in the art could readily change the physical configurations specifically shown without departing from the scope of the present invention. For example, while temperature sensors 32, 32' and 32" have been used to control the switching of the diverting valves 28, 28' and 28" respectively, it will be evident that other methods can be used besides measurement of temperature. Additionally, a sensor (not shown) can be provided which is in the form of a flow meter which provides a control signal to the diverting valves upon the measure of a predetermined amount of water which can be selected to correspond to the proximate amount of standing water within the hot water lines. It can be established, therefore, that once a predetermined amount of water has flowed through a given pipe (substantially corresponding to the length of the hot water line 24 between the adjustment valve 18 and the hot water heater 38) that hot water will be available at the shower nozzle 14. Similarly, it is also possible to control the diverting valve 28 by means of a timer. Thus, it can be determined that when the adjustment valve 18 is open a predetermined time will elapse to allow all the standing water to be recirculated and the cold water in the pipes to be replaced by hot water from the hot water heater 38. Assuming that the adjustment valve 18 is fully opened, under normal pressures, the time period can readily be established by which hot water will be available at the nozzle 14. Therefore, it will be appreciated, that the specific approach used in causing the switching of the valves 28, 28' and 28" from one condition or position to the other is not critical and any such means can be used with different degrees of advantage. Also, the present invention can utilize diverting valves which have three operative conditions. In a third condition, the water which is fed by the inlet line 26 is also diverted to the return line 30 and not permitted to flow through the shower nozzle 14. The third condition can be selected by similar controller means, such as a temperature sensor, which determines that the temperature of the water at the water nozzle 14 exceeds a predetermined temperature. Such a sensor and diverting valve can be used with this recirculation system to prevent inadvertent flow of very hot or scalding water through the shower nozzle 14 which can easily cause damage or injury to a user.

Numerous valves are known which can be used or modified to be used to serve as the diverting valve 28. Examples of such valves are disclosed in the following U.S. Pat. Nos.: 1,954,903; 2,508,074; 2,569,838; 2,672,157; 2,826,367; 2,837,282; 2,872,116; 2,886,245; 2,889,113; 2,901,174; 2,905,387; 2,982,475; 3,001,717; 4,116,377; and 4,669,653. However, the specific design of the diverting valve is not critical and numerous known temperature responsive valves, thermostats, etc. can be used to selectively control the flow of water in the system.

I claim:

1. Method of conserving water in a heated water dispensing system comprising the steps of supplying cold and hot water to a temperature adjustment valve; adjusting the valve to select a desired water temperature by selecting mixing hot and cold water; dispensing the water at the selected desired temperature; sensing the temperature of the mixed water before it is dispensed; and diverting water from said dispensing location to thereby prevent water from being dispensed and returning the water to a source of the hot or cold water only when the temperature sensed is outside a predetermined water temperature range, whereby water is conserved by recirculation of mixed water which cannot be used because its temperature is outside the desired predetermined water temperature range.

2. Water recirculation system comprising a first supply means for supplying cold water; second supply means for supplying hot water; adjusting valve means for selectively mixing the hot and cold water of said first and second supply means to select a desired water temperature; water dispensing means for dispensing water at said selected desired temperature; sensing means for sensing the temperature of the mixed water before it is dispensed by said water dispensing means; water return means for diverting water from said water dispensing means to at least one of said supply means only when the temperature sensed by said sensing means is outside a predetermined water temperature range, whereby water is conserved by recirculation of mixed water which cannot be used because its temperature is outside the desired predetermined water temperature range.

3. Recirculation System as defined in claim 2, wherein said second supply means includes a hot water heater and said water return means diverts the water to said hot water heater.

4. Recirculation System as defined in claim 3, wherein said water return means comprises a return valve having an inlet connected to said adjusting valve means, a first outlet connected to said water dispensing means and a second outlet connected to said water heater, said inlet being selectively connected to one of said outlets, said sensing means controlling the connections between said inlet and outlet ports.

5. Recirculation System as defined in claim 4, wherein said sensing means is arranged on said inlet between said adjusting valve means and said return valve.

6. Recirculation System as defined in claim 4, further comprising a water holding tank between said return valve and said hot water heater for at least temporarily storing recirculated water diverted by said return valve before being returned to said hot water heater.

7. Recirculation System as defined in claim 6, further comprising pumping means for pumping water from said water holding tank to said hot water heater.

8. Recirculation System as defined in claim 7, further comprising actuation means for selectively actuating said pumping means.

9. Recirculation System as defined in claim 8, wherein said actuation means comprises temperature sensing means for sensing the temperature of the water flowing between said hot water heater and said adjusting valve means, whereby an increase in temperature sensed by said temperature sensing means applies electrical power to said pumping means.

10. Recirculation System as defined in claim 8, wherein said actuation means comprises pressure sensing means for sensing a change in pressure of the water flowing between said hot water heater and said adjusting valve means, whereby a decrease in pressure detected sensed by said pressure sensing means applies electrical power to said pumping means.

11. Recirculation System as defined in claim 7, further comprising overflow means for receiving water from said water holding tank when said hot water heater is full and recirculated water must be pumped from said water holding tank.

12. Recirculation System as defined in claim 11, further comprising waste water valve means for selectively allowing water from said water holding tank to be discarded to said overflow means.

13. Recirculation System as defined in claim 12, further comprising water level sensing means for sensing the level of water in said water holding tank and enabling said waste water valve means to discard waste water when said holding tank is full.

14. Recirculation System as defined in claim 17, wherein said water level sensing means comprises a float actuated electrical switch.

15. Recirculation System as defined in claim 2, wherein a plurality of water dispensing means are provided each provided with an adjusting valve means and water return means, all said water return means being connected to each other.

16. Recirculation System as defined in claim 5, wherein each of said water return means is arranged to divert water from an associated water dispensing means to a common supply means.

17. Recirculation System as defined in claim 2, wherein a plurality of water dispensing means are provided each of which is connected to said water return means.

18. Recirculation System as defined in claim 2, wherein said sensing means senses the temperature of the mixed water before it is dispensed by said water dispensing means, said water return means diverting water when the temperature sensed by said sensing means is below a predetermined water temperature.

19. Recirculation System as defined in claim 2, wherein said second supply means includes hot water lines feeding hot water from a hot water heater and further comprising timer means for establishing a predetermined period of time after said adjusting valve means is actuated to permit water to flow towards said water dispensing means, said predetermined period of time substantially corresponding to the time it takes for standing water in said hot water lines to be replaced by hot water.

20. Recirculation System as defined in claim 2, wherein said second supply means includes hot water lines feeding hot water from a hot water heater and further comprising a fluid flow detector for establishing a quantity of water that substantially corresponds to the standing water in said hot water lines.

* * * * *